US006076473A

United States Patent [19]

Conte

[11] Patent Number: 6,076,473

[45] Date of Patent: Jun. 20, 2000

[54] TABLE FOR ACCOMMODATING THE COMPONENTS OF A COMPUTER

[76] Inventor: Stefano Conte, Via Benzi, 10/B, 31100 Treviso, Italy

[21] Appl. No.: 09/250,250

[22] Filed: Feb. 16, 1999

[30] Foreign Application Priority Data

Feb. 26, 1998 [IT] Italy ..... TV98A0023

[51] Int. Cl.[7] ..... A47B 81/00

[52] U.S. Cl. ..... 108/50.01; 312/223.3

[58] Field of Search ..... 312/223.1, 223.2, 312/223.3; 108/50.01, 50.02; 361/683, 724, 725, 727

[56] References Cited

U.S. PATENT DOCUMENTS

| | | | |
|---|---|---|---|
| 4,636,781 | 1/1987 | Wills et al. | 312/223.2 X |
| 4,669,789 | 6/1987 | Pemberton | 312/194 X |
| 4,695,104 | 9/1987 | Lederman | 312/324 X |
| 5,101,736 | 4/1992 | Bommarito et al. . | |
| 5,452,950 | 9/1995 | Crenshaw et al. | 312/223.3 |
| 5,461,974 | 10/1995 | Reneau . | |
| 5,587,877 | 12/1996 | Ryan et al. | 361/683 |
| 5,611,608 | 3/1997 | Clausen | 312/223.3 |
| 5,680,820 | 10/1997 | Randolph | 312/223.3 X |
| 5,763,985 | 6/1998 | Asinovsky | 312/223.3 X |
| 5,878,673 | 3/1999 | Kramer et al. | 108/64 X |
| 5,897,178 | 4/1999 | Ohara | 312/223.2 |

FOREIGN PATENT DOCUMENTS

| | | | |
|---|---|---|---|
| 3413961 | 10/1985 | Germany | 312/322 |
| 4115151 | 11/1992 | Germany | 312/223.3 |

*Primary Examiner*—Peter M. Cuomo
*Assistant Examiner*—Hanh V. Tran
*Attorney, Agent, or Firm*—Guido Modiano; Albert Josif; Daniel O'Byrne

[57] ABSTRACT

A table for accommodating the components of a computer, particularly of the type known as personal computer. The table comprises a working surface, which is supported by legs, and has a first compartment which is designed to accommodate the fixed components of a computer. The controls of the computer, which is recessed in the compartment, and the slots for accessing the reader/writer/recorded units, are arranged in the front edge of the table, thus leaving the entire working surface uncluttered.

9 Claims, 5 Drawing Sheets

TABLE FOR ACCOMMODATING THE COMPONENTS OF A COMPUTER

BACKGROUND OF THE INVENTION

The present invention relates to a table for a computer, particularly of the type known as personal computer.

Due to the rapid development of computer technology and the drop in component production costs, currently no company can maintain a good level of competitiveness without the aid of a computer.

Differently from what occurred up to the 1980s, when only a small number of specialized or high-capital companies could benefit from the advantages offered by the computer, nowadays every company must resort to this tool both to increase its own productivity and to utilize new tools which, if not used, would cause a considerable competitive disadvantage.

It is known, for example, that word processing long ago permanently replaced the use of pen and paper; that accounting is managed entirely by using customized programs or spreadsheets; and that the filing of history data is much more convenient, both in terms of querying and of physical bulk, if managed on a computer.

It is quite often necessary to resort to this work tool in private life as well, and the widespread availability of computers in families is a fact that has been repeatedly confirmed by statistical research, which has pointed out its exponential increase.

Other factors, such as the diffusion of the Internet or the recent introduction of home banking, have also contributed to this large-scale phenomenon: accordingly, a condition has arisen in which it is necessary to combine the use of the desk in the conventional sense with a specific use meant to exploit all the advantages offered by the computer.

However, some negative aspects, too, have become apparent in this new context: in particular, one of the main drawbacks is the fact that a computer occupies much of the space available on the user's desk, often compromising the optimum use of the work environment and introducing an unpleasant awkwardness factor regardless of the physical shape of the computer chosen.

According to this aspect, computers for desktop use are in fact divided into two categories:

a) so-called desktop computers, i.e., computers constituted by a horizontally arranged case;

b) tower and minitower computers, i.e., computers constituted by a vertically arranged case.

Both categories have logistic disadvantages: in particular, desktop computers occupy a lot of desk space and even if one attempts to optimize their bulk by placing the monitor on top of them, the result is certainly not satisfactory.

On the other hand, instead, while it is true that tower computers can be kept on the floor and accordingly do not occupy the work surface, it is also true that they have the severe disadvantage of being obviously awkward when it is necessary to insert recording media or connect a communications cable; this is not a negligible factor considering that many users choose computers for desktop use.

A further disadvantage which is common to both categories is the hindrance caused by the many cables required for the power supply and operation of the computer and of its monitor and for connection among the various peripherals of said computer.

Over the years these problems have become increasingly evident and felt, to the point of unleashing the creativity of desk designers: a range of tables has thus been created specifically to optimize space in the presence of a computer, and over time this range has become very wide and differentiated.

However, there are three main disadvantages that have not been solved satisfactorily so far:

1) a table is designed either as a conventional table or as a table meant exclusively for using the computer: the second type, however, still makes it difficult and often even impossible to combine the presence of the computer with the conventional use of the table, which is still necessary in any case (for reading a book, taking notes, etcetera), while the conventional table, despite being obviously more versatile for combined use, wastes most of its surface to accommodate the computer, considerably reducing the space usable for conventional purposes, and does not offer the same practicality in interaction with said computer;

2) the cables that connect the various parts of the computer are an awkward bulk and often hinder movements;

3) physical access to the computer, especially in the case of a conventional table, always forces one to make unwanted movements (for example reaching over the table to access the slot for inserting a disk).

It is evident to anyone, by opening the case of any computer, that the amount of empty space inside the case of the computer is greater than the amount of filled space.

The case is in fact shaped like a parallelepiped in which the front part is exactly as high as the rear part, even though the internal space occupation of the cards of the computer reveals mutually very different dimensions.

SUMMARY OF THE INVENTION

The aim of the present invention is to solve the above-mentioned drawbacks of the cited prior art by providing a table which allows optimum utilization of the space in the presence of a computer and therefore combines the advantages of working on a conventional table with the possibility to use a computer on that same table comfortably and practically, without wasted space and without compromises.

Within the scope of the above aim, an object of the present invention is to provide a table which preserves all the inherent advantageous characteristics of a computer, such as the possibility to upgrade it over time by replacing with new technology the parts that have become obsolete.

A further object is to provide a table which associates with the preceding characteristics that of being producible with conventional technologies and of having ordinary dimensions.

This aim, these objects and others which will become apparent hereinafter are achieved by a computer table which comprises a working surface supported by legs, characterized in that said working surface has at least one first compartment which is designed to accommodate fixed components of a computer.

Conveniently, the at least one computer compartment is L-shaped, so as to occupy, under the table, only the space strictly required to contain the cards for the computer or other components.

Advantageously, the power switches and the slots for the magnetic and optical units are located in the front portion of the thickness of the working surface of the table, allowing the user to have immediate access thereto.

Moreover, the computer is conveniently provided with a system of internal cooling fans which keep its temperature at stable values even in case of continuous use.

BRIEF DESCRIPTION OF THE DRAWINGS

Further characteristics and advantages of the invention will become apparent from the following detailed description of a preferred but not exclusive embodiment of the device, illustrated only by way of non-limitative example in the accompanying drawings, wherein.

DESCRIPTION OF THE PREFERRED EMBODIMENTS

Figure 1:
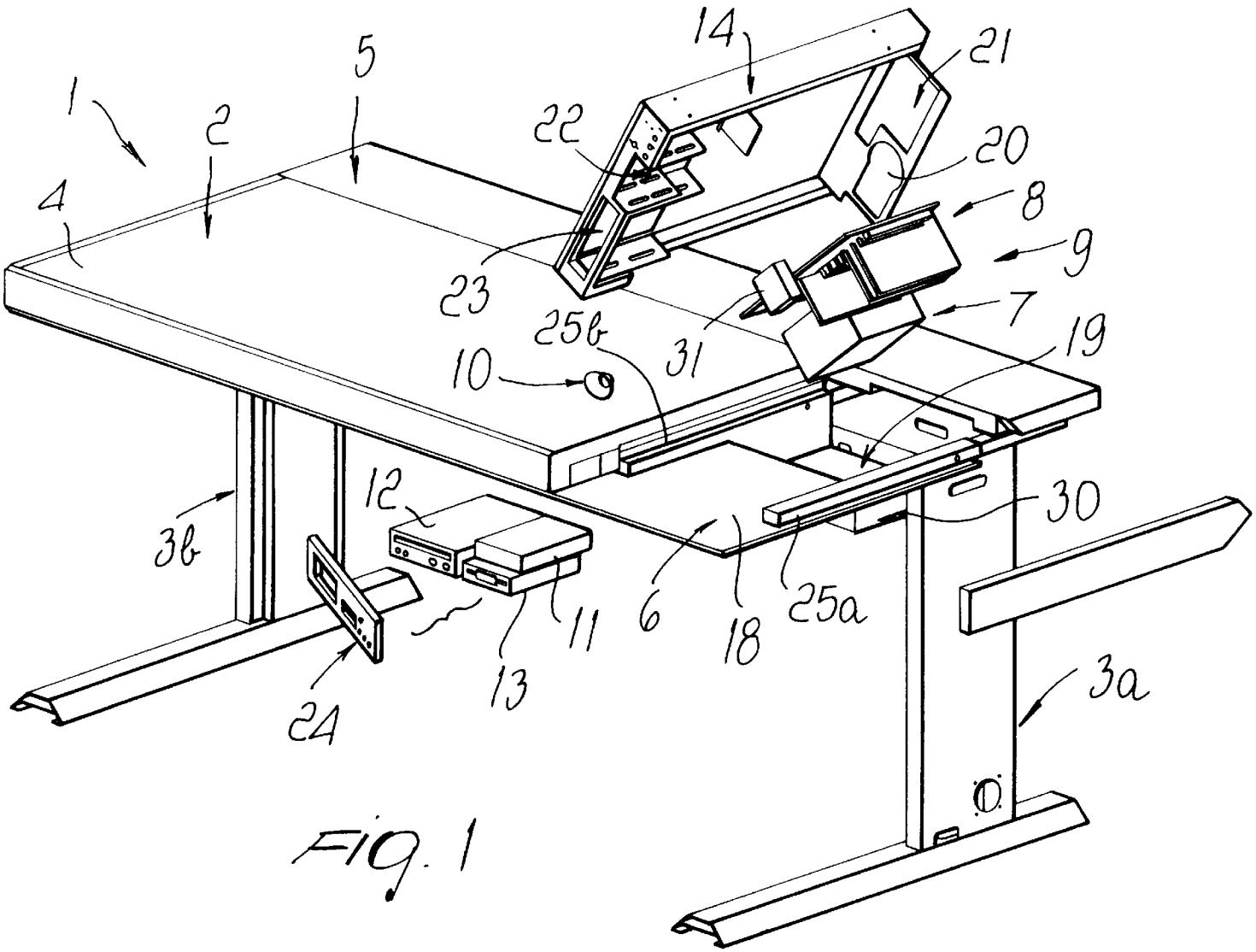
FIG. 1 is a first exploded perspective view of the table according to the present invention.
Figure 2:
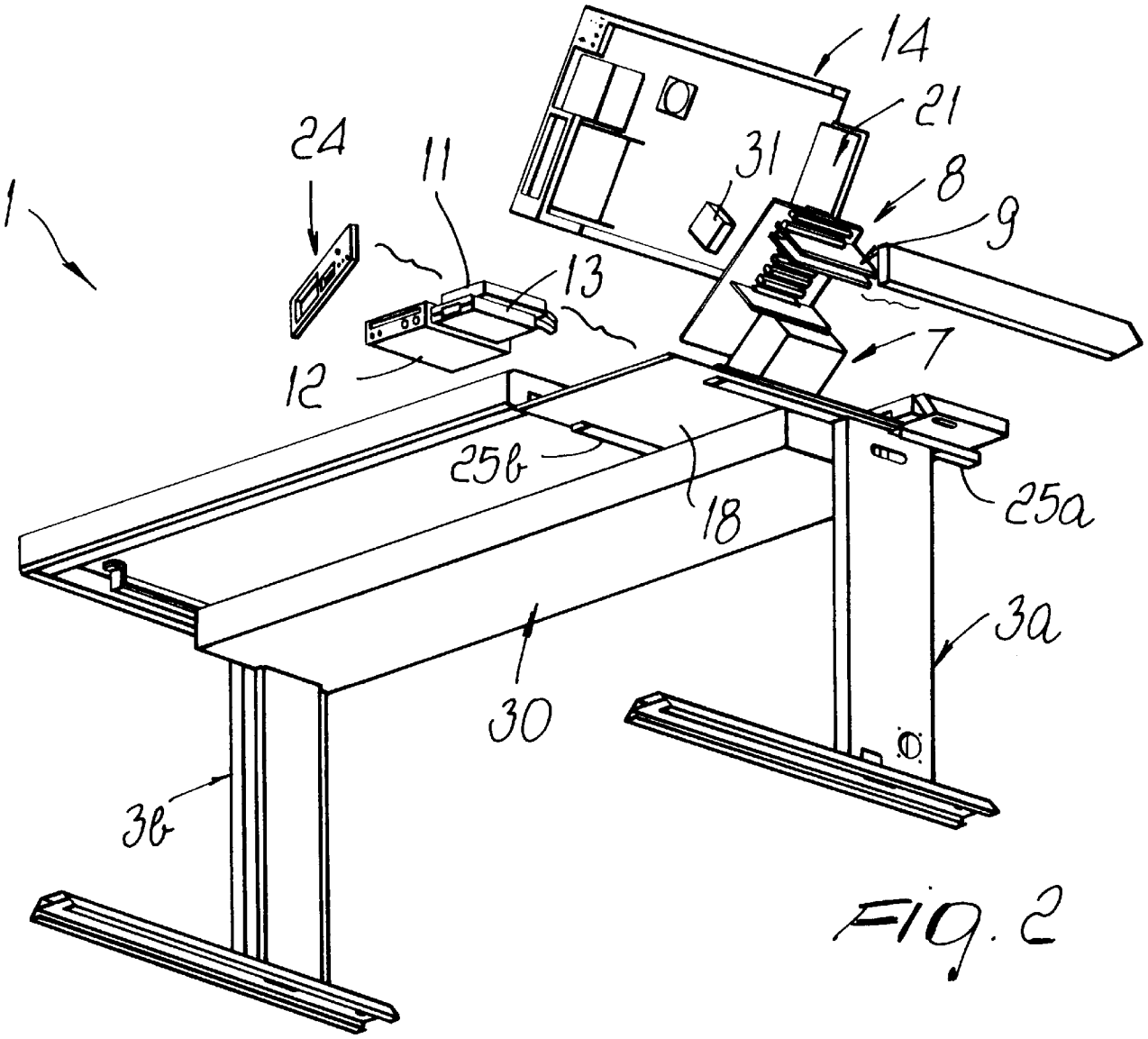
FIG. 2 is a second exploded perspective view of the table according to the present invention.
Figure 3:
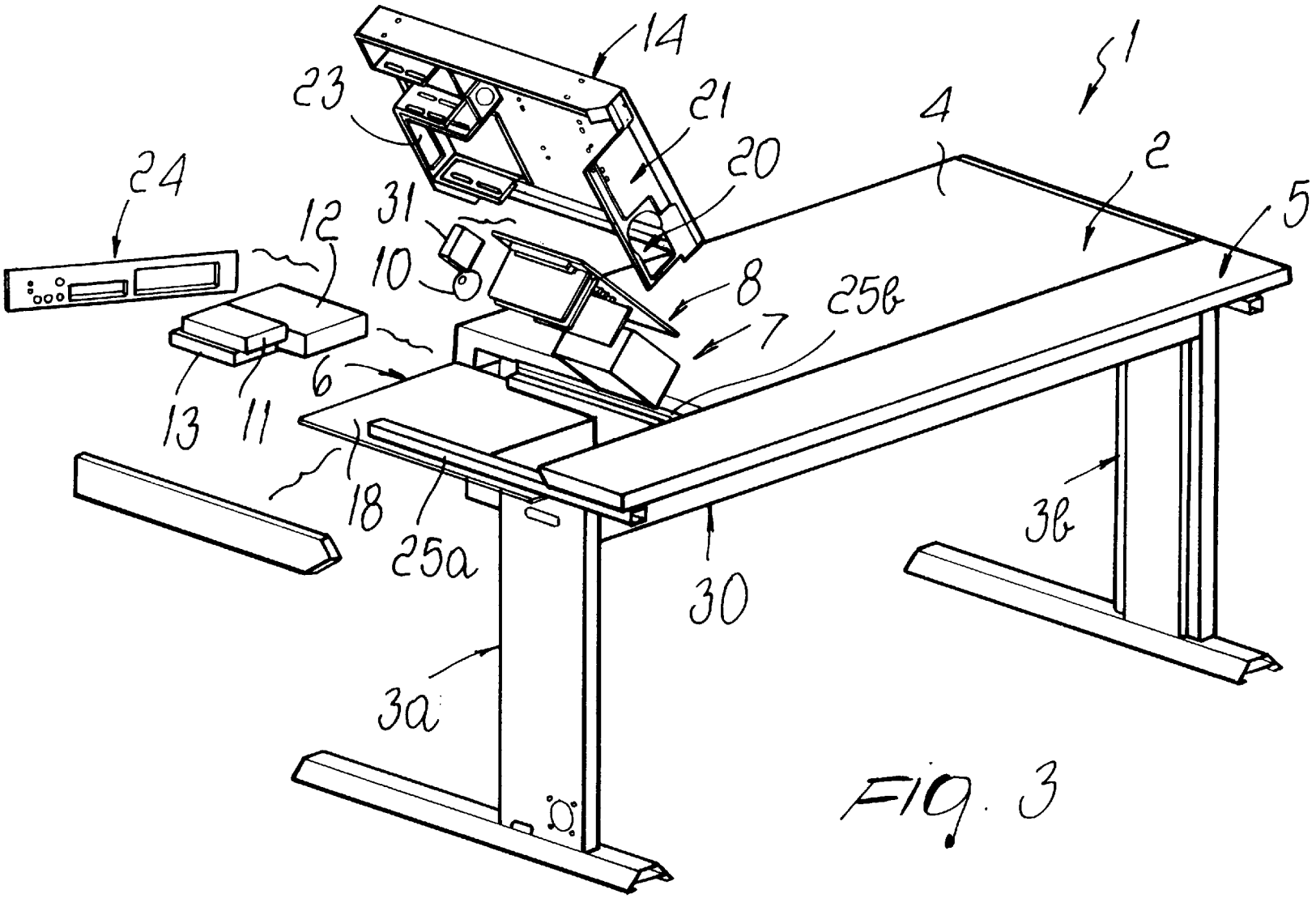
FIG. 3 is a third exploded view of the table of the present invention.
Figure 4:
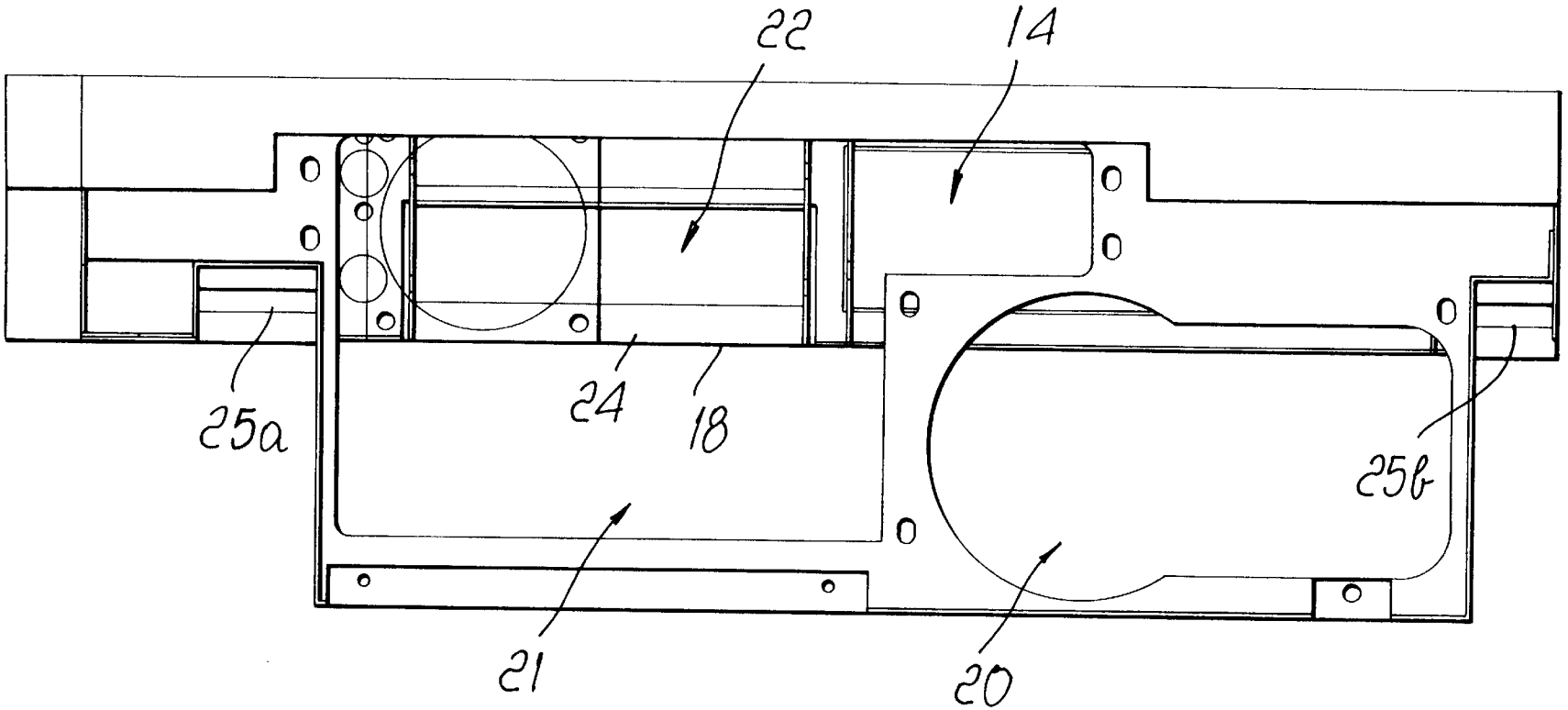
FIG. 4 is a rear view of the container of the computer.
Figure 5:
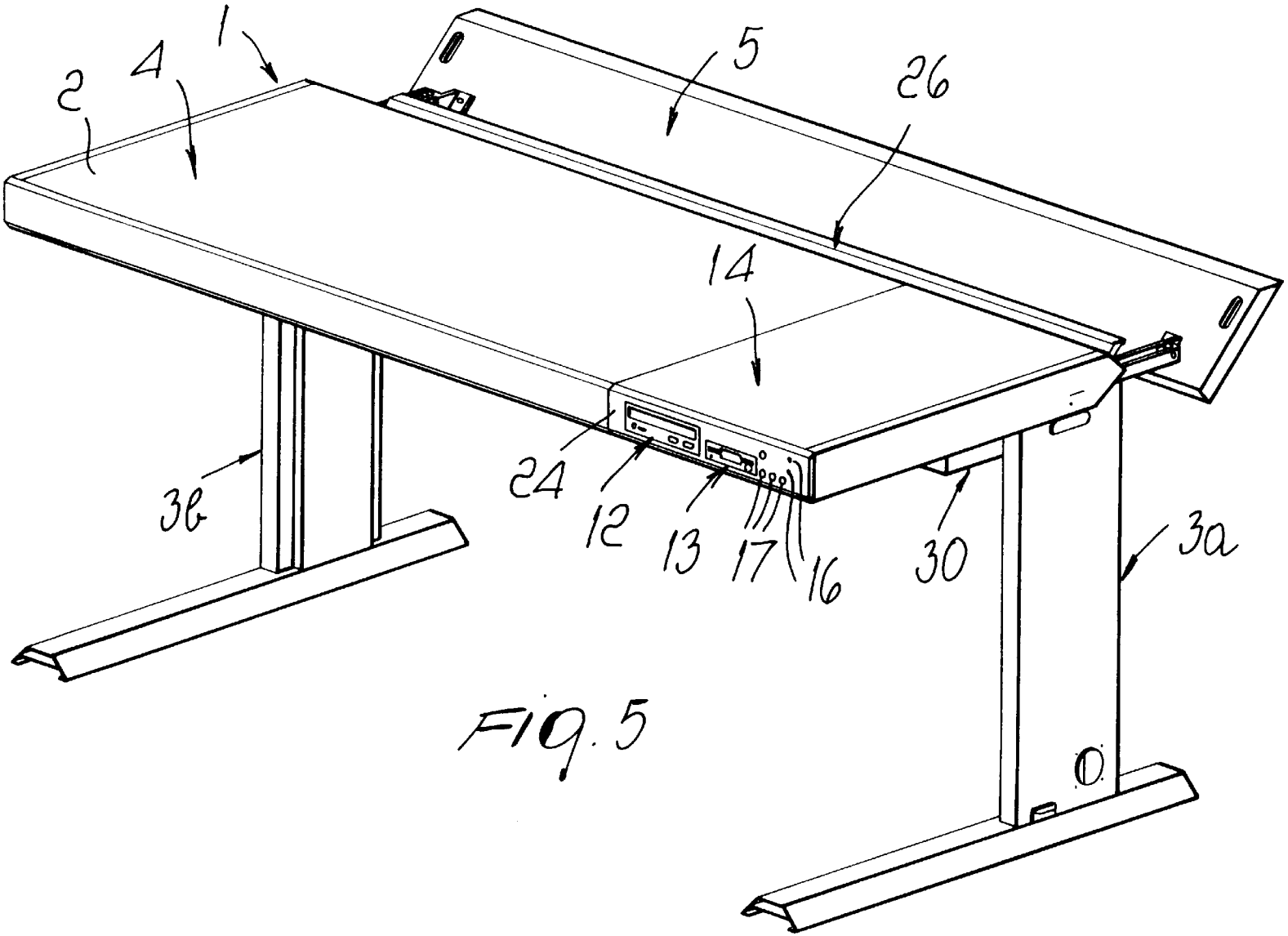
FIG. 5 is a general perspective view of the table of the present invention.

With reference to the above FIGS. 1 to 5, 1 designates a computer table which is substantially constituted by a working surface 2 supported by two legs 3*a* and 3*b*.

The working surface 2 is divided into at least one first fixed part 4, to the rear of which an element 5 is associated; said element can be turned over or removed with respect to said first part.

At least one first compartment 6, preferably L-shaped, is formed at the first fixed part 4 of the working surface 2, preferably at a cross-member 30 and on the right side. The first compartment accommodates the fixed electronic components of the computer, which are constituted by the elements that are contained in a conventional case of a personal computer, such as the power supply 7, the motherboard 8, the expansion cards 9 (graphics card, sound card, controller cards), the speaker 10, the hard disk 11 and the devices for reading/writing magnetic-optical units 12 and 13, such as 3½-inch or 5¼-inch diskette read/write drives, CD-ROM readers/recorders, optical disk readers, read/write drives for advanced magnetic units (disks containing 100 or more megabytes), removable hard disks.

The L-shaped configuration of the first compartment 6 forms a first front wing, which is as thick as the working surface 2 and comprises a first base 18 which is parallel to the plane of arrangement of the first fixed part 4; and a second rear wing, which protrudes at right angles to the working surface 2 and comprises a second base 19 which is parallel to the first base 18 but lies on a lower plane.

It is well-known that every computer for desktop use is composed of a bottom and of a cover and that all the electronic components are fixed to the bottom, so that by unscrewing the cover it is possible to access the inside of the computer.

In the present solution, front controls, i.e., power and hardware control buttons 16 and indicator lights 17, as well as the magnetic-optical units 12 and 13, are installed after turning them through 180° about their horizontal axis.

The entire computer is then in turn rotated through 180° with respect to the horizontal axis: the controls accordingly return to the correct position, the cover is designated by the reference numeral 14 and the bottom is constituted by the first base 18 and by the second base 19.

All the components are therefore fixed to the cover 14.

The cover 14 therefore has the typical configuration of the bottom of a desktop computer; in particular, in the rear region it is provided with a first intake opening 20 for the power supply cooling fan and a second opening 21 allowing access to the rear connection ports of the computer; in the front region there are a third front opening 22 and a fourth front opening 23 for the magnetic-optical recording units which can be accessed from the front edge of the table according to the invention, the controls of which can be accessed through a faceplate 24.

Once the various components have been fitted to the cover 14, said cover and the base 18 are associated with the first compartment 6 for example by using suitable connecting screws and/or bolts; the entire assembly is coupled to the legs and/or to the cross-member, for example, by means of a pair of guides 25*a* and 25*b*. The parts that constitute the computer, particularly of the personal computer type, are all commercially available.

The cooling system is constituted by three fans (omitted in the figures); one is placed within in the power supply (all commercially available power supplies come complete with a fan), one is an internal fan used exclusively to cool the processor (all modern processors have one), and the third fan is an additional internal fan 31 which directs the air stream toward the expansion cards.

The table according to the invention is further provided with an element 5, which is connected so that it can be turned over, for example by means of suitable hinges, to the first fixed part 4 and allows to access at least one second compartment 26, which is connected to the first compartment 6 and is suitable to accommodate cables for supplying power to the computer and/or for connection to the monitor and/or to other peripherals and/or for any other necessary elements; it is possible to sequentially insert a third compartment or further compartments for a possible better placement of the components or in order to raise the second compartment with respect to the ground.

The operation of the invention is similar to that of a conventional computer, where the user operates the buttons 17 to switch on the computer, the fixed components of which are concealed from him.

The magnetic-optical recording units are inserted by acting on the slots that are located in the front edge of the table and can be accessed through the faceplate 24. Free access to the rear connection ports of the computer is gained once the element 5 has been turned over. The monitor (not shown in the figure) can be arranged in the manner that best suits the working pattern of the user, in a central or lateral position. Since the fixed components of the computer are assembled in a conventional manner, i.e., by interlocking and by using screws, the possibility is preserved of expanding the computer in order to adapt it to more advanced technologies, since it is sufficient, as in the case of a conventional computer, to lift the cover and replace or add the new components.

It has thus been observed that the table of the invention allows to conceal the computer below the working surface, drastically increasing the space available on the desktop or even in the immediate vicinity of the table, so as to allow for example to place a chest of drawers. It has also been observed that the computer's operating comfort benefits from the arrangement of the control buttons and of the optical-magnetic unit insertion slots in the front edge of the table.

Finally, the obstacles caused by loose cables in the direct vicinity of the table have been eliminated, since all the cables for connection between the computer and the peripherals are contained within the table proper.

The materials used in manufacturing the table and its dimensions may be any according to the requirements.

The invention thus conceived is susceptible of numerous modifications and variations, all of which are within the scope of the inventive concept.

Thus, for example, the overturning element 5 which runs along the entire length of the table can be replaced with another overturning surface which covers only the length required to provide access to the rear connections of the computer, keeping the remaining part fixed. The first L-shaped compartment 6 can be arranged symmetrically in the left part instead of in the right part, for example in the case of left-handed users. The supporting structure of the table can be different from the one described in order to obtain aesthetic results which are suitable for the working environment.

The method for anchoring the components to the table also may be the most appropriate according to specific requirements, so as to allow for example the insertion of the components of the computer frontally or laterally with respect to the working surface 2.

Finally, it is possible to provide for the use of an overturning or sliding front panel which is associated so as to provide partial or total temporary covering of the faceplate 24.

The materials and the dimensions that constitute the individual components of the invention may of course also be the most pertinent according to specific requirements.

The disclosures in Italian Patent Application No. TV98A000023 from which this application claims priority are incorporated herein by reference.

What is claimed is:

1. A computer table (1), comprising:

a working surface element (2) having a top planar extension and a front portion extending perpendicularly below said top planar extension;

legs **(3*a*,3*b*)** connected with said working surface element for supporting said working surface element such that said top planar extension of said working surface element is arranged horizontally and said front portion of said working surface element is arranged vertically;

at least one first compartment (6) provided in said working surface element, said at least one first compartment extending below said top planar extension and behind said front portion of said working surface;

a computer cover element (14) having a top side and a bottom side;

computer components fixed to the bottom side of said computer cover element;

said computer cover element being arranged in said at least one first compartment such that said top side of said computer cover element extends in the same plane as said top planar extension of said working surface element and such that said computer components fixed to the bottom side of said computer cover element are arranged inside said at least one first compartment and such that selected ones of said computer components are arranged accessible to a user adjacent said front portion of said working surface element.

2. The computer table according to claim 1, further comprising a second compartment (26) which is provided rearwardly in said working surface element and which is connected to said first compartment and accessible to a user by means of an element (5) which is movable with respect to said working surface element.

3. The table according to claim 2, wherein said working surface element comprises at least one first fixed part (4), to the rear of which said element is located.

4. The table according to claim 1, wherein said at least one first compartment is L-shaped.

5. The table according to claim 4, wherein the L-shaped configuration of said at least one first compartment forms a first front wing, which is as thick as said front portion of said working surface element and comprises a first base (18), which is parallel to the plane of arrangement of said top planar extension of said working surface element, and second rear wing, which protrudes at right angles to the top planar extension of said working surface element and comprises a second base (19) which is parallel to said first base lies on a lower plane.

6. The table according to claim 5, wherein said first and second bases form a bottom base for said computer components.

7. The device according to claim 6, wherein said cover element and said bottom base are mutually assembled and coupled to said working surface element by way of a pair of guides **(25*a*,25*b*)**.

8. The table according to claim 1, wherein said selected ones of said computer components arranged accessible to a user adjacent said front portion of said working surface element comprise power and hardware control buttons and slots for insertion of magnetic-optical units.

9. The table according to claim 1, wherein said computer components comprise cooling fans.

* * * * *